US007530294B2

(12) United States Patent
Myburgh

(10) Patent No.: US 7,530,294 B2
(45) Date of Patent: May 12, 2009

(54) POWERED ADJUSTABLE PIPE WRENCH

(76) Inventor: Herman Myburgh, 6995 Craddock La., Lascassas, TN (US) 37085

( * ) Notice: Subject to any disclaimer, the term of this patent is extended or adjusted under 35 U.S.C. 154(b) by 0 days.

(21) Appl. No.: 12/003,380

(22) Filed: Dec. 21, 2007

(65) Prior Publication Data

US 2008/0098857 A1 May 1, 2008

Related U.S. Application Data

(63) Continuation-in-part of application No. 11/907,516, filed on Oct. 12, 2007.

(60) Provisional application No. 60/851,281, filed on Oct. 13, 2006.

(51) Int. Cl.
*B25B 21/00* (2006.01)

(52) U.S. Cl. ..... 81/57.15; 81/57; 81/57.11; 81/57.16

(58) Field of Classification Search ..... 81/57, 81/57.11, 57.15, 57.16
See application file for complete search history.

(56) References Cited

U.S. PATENT DOCUMENTS

| | | | | |
|---|---|---|---|---|
| 2,122,760 | A | 7/1938 | Scott et al. | |
| 2,486,755 | A | 11/1949 | Mitchell | |
| 3,709,072 | A | 1/1973 | Rogers | |
| 3,988,946 | A | 11/1976 | Gonzalez | |
| 4,729,269 | A * | 3/1988 | Killian | 81/57.11 |
| 5,000,065 | A | 3/1991 | Haynes | |
| 5,138,915 | A * | 8/1992 | Doll | 81/463 |
| 6,253,643 | B1 | 7/2001 | Buck | |
| 6,332,377 | B1 | 12/2001 | Pietras et al. | |
| D530,166 | S | 10/2006 | Becker et al. | |
| 2001/0003253 | A1 * | 6/2001 | McDonnell | 81/109 |
| 2003/0010160 | A1 | 1/2003 | Dugan | |
| 2004/0025642 | A1 | 2/2004 | Hsien | |

* cited by examiner

*Primary Examiner*—Joseph J Hail, III
*Assistant Examiner*—Shantese McDonald
(74) *Attorney, Agent, or Firm*—Richard C. Litman

(57) ABSTRACT

The powered adjustable pipe wrench has a motorized rotary grip to rotate a pipe component clamped therein and a laterally spaced stationary grip to hold a second pipe component stationary relative to the first as it is being rotated. The pipe wrench may have a cylindrical jaw housing with semicylindrical fixed and openable portions hinged to one another. One end of the housing includes a powered component to rotate the pipe component held therein, while the other housing end includes fixed jaw components holding the second pipe component stationary. Alternatively, the pipe wrench may have a powered component extending from the fixed jaw of the wrench body to rotate the first pipe component, and a rectilinearly adjustable jaw portion extending from the wrench body. A set of fixed jaw components is axially spaced from the rotary component to hold the second pipe component stationary.

19 Claims, 11 Drawing Sheets

POWERED ADJUSTABLE PIPE WRENCH

CROSS-REFERENCE TO RELATED APPLICATIONS

This application is a continuation-in-part of U.S. patent application Ser. No. 11/907,516, filed on Oct. 12, 2007, which claims the benefit of U.S. Provisional Patent Application Ser. No. 60/851,281, filed Oct. 13, 2006.

BACKGROUND OF THE INVENTION

1. Field of the Invention

The present invention relates generally to tools used in the plumbing trade, and more particularly to a powered adjustable pipe wrench for use with threaded pipe and threaded pipefittings.

2. Description of the Related Art

The current practice of attaching, tightening, loosening, and removing threaded pipe components to one another is a manual process, with two pipe wrenches normally being employed. One pipe wrench is adjusted and attached to grip the threaded first component, e.g., a pipe fitting, etc., and rotate the component in the desired direction. The second pipe wrench is adjusted and attached to grip the second component (pipe or fitting, etc.) to rotate the second component in the opposite direction, or to hold the pipe while the first wrench is used to rotate the first component, in order to thread or unthread the two components to or from one another. This process is normally performed by a person manually pushing and pulling the handles of the pipe wrenches together to compensate for torque. When a suitable fixed object is available in close proximity to the work being performed, the handle of one pipe wrench may be braced against the fixed object while the second pipe wrench handle is rotated toward or away from the first pipe wrench to perform the desired threading or unthreading of the two pipe components.

This operation often requires the exertion of significant human physical force for proper performance, and may result in injury to the person performing this function, as well as injury to helpers or bystanders. This is all the more so when this process is performed while the worker is standing on a ladder, scaffold or lift, and the pipe assembly is overhead. This operation may also be performed while standing on the ground employing clamping tables or threading machines to clamp or hold either the pipe or the pipe fitting, and the mating pipe or fitting is gripped with a pipe wrench. Working on the ground using clamping tables or the like does marginally reduce the physical exertion as well as the risk of personal injury. However, the majority of the plumbing work involving the threading and unthreading of pipes and pipe fittings has to be done overhead while working in the air on a platform or the like.

The practice of using pipe wrenches for the threading, unthreading, tightening and loosening of threaded pipe and threaded pipe fittings has existed from the inception of threaded pipe and threaded pipe fittings, with virtually no change to pipe wrench design, other than the introduction of self-adjusting pipe wrenches. Despite substantial awareness of worker safety, as well as increased legislation in this field, no powered tool has yet been developed specifically for this potentially unsafe, physically strenuous, everyday process wherein two pipe components must be rotated relative to one another. Numerous electric, pneumatic and hydraulic power tools, including nut setters, air wrenches, electric screwdrivers, electric drills, impact wrenches, riveters, threading tools, etc., are currently available for practically every traditionally manual operation. All these power tools significantly improve worker safety, productivity and mobility, in addition to drastically reducing worker fatigue.

Thus, a powered adjustable pipe wrench solving the aforementioned problems is desired.

SUMMARY OF THE INVENTION

The powered adjustable pipe wrench has two laterally spaced jaw sets. One of the jaw sets includes a motorized drive for rotating one of the pipe components, while the other jaw set has non-rotating jaws for holding the second pipe component stationary relative to the first component. Thus, the powered adjustable pipe wrench produces equal and opposite torques to rotate the two pipe components relative to one another, with zero net torque being applied to the tool.

A first embodiment of the device includes two semicircular jaws in each jaw set, with each jaw set having a stationary jaw and an opposite openable jaw. The stationary jaw half of the powered jaw set includes a motorized drive to rotate a pipe or fitting clamped therein, while the non-powered jaw set clamps the other pipe component to prevent relative rotation thereof while the powered jaw set rotates its component.

The second embodiment includes rectilinearly adjustable jaw sets, again with one jaw set including a motorized drive to rotate the pipe component and the other jaw set serving to hold its pipe component stationary relative to the component held in the motorized jaw set. Each embodiment is adjustable to compensate for different pipe and fitting diameters. An elongate handle and supplemental handgrip are provided, as well as switches for controlling the amount of torque produced, rotational speed, and other factors.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
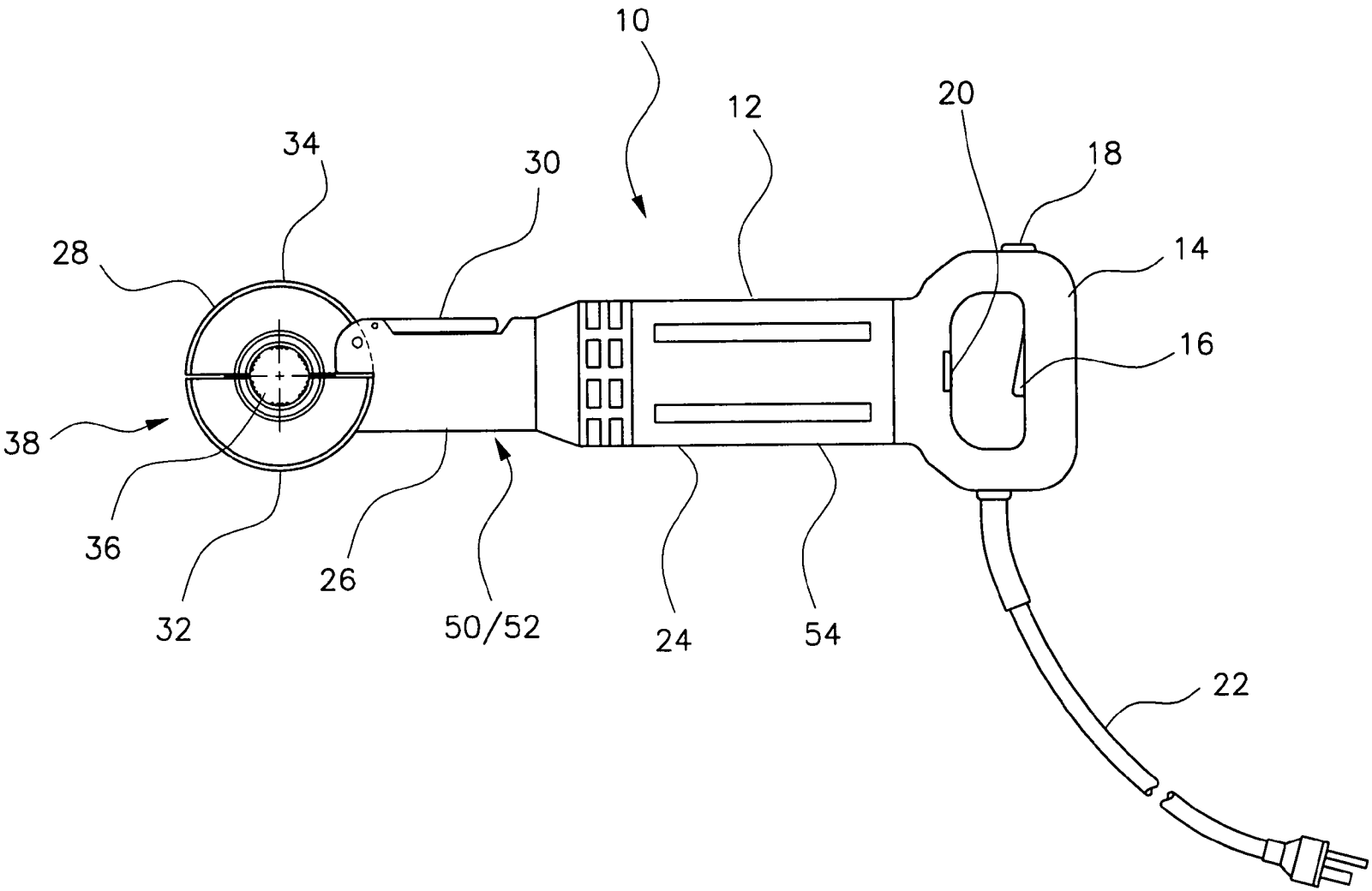
FIG. 1 is a side elevation view of a first embodiment of the powered adjustable pipe wrench according to the present invention.
Figure 2:
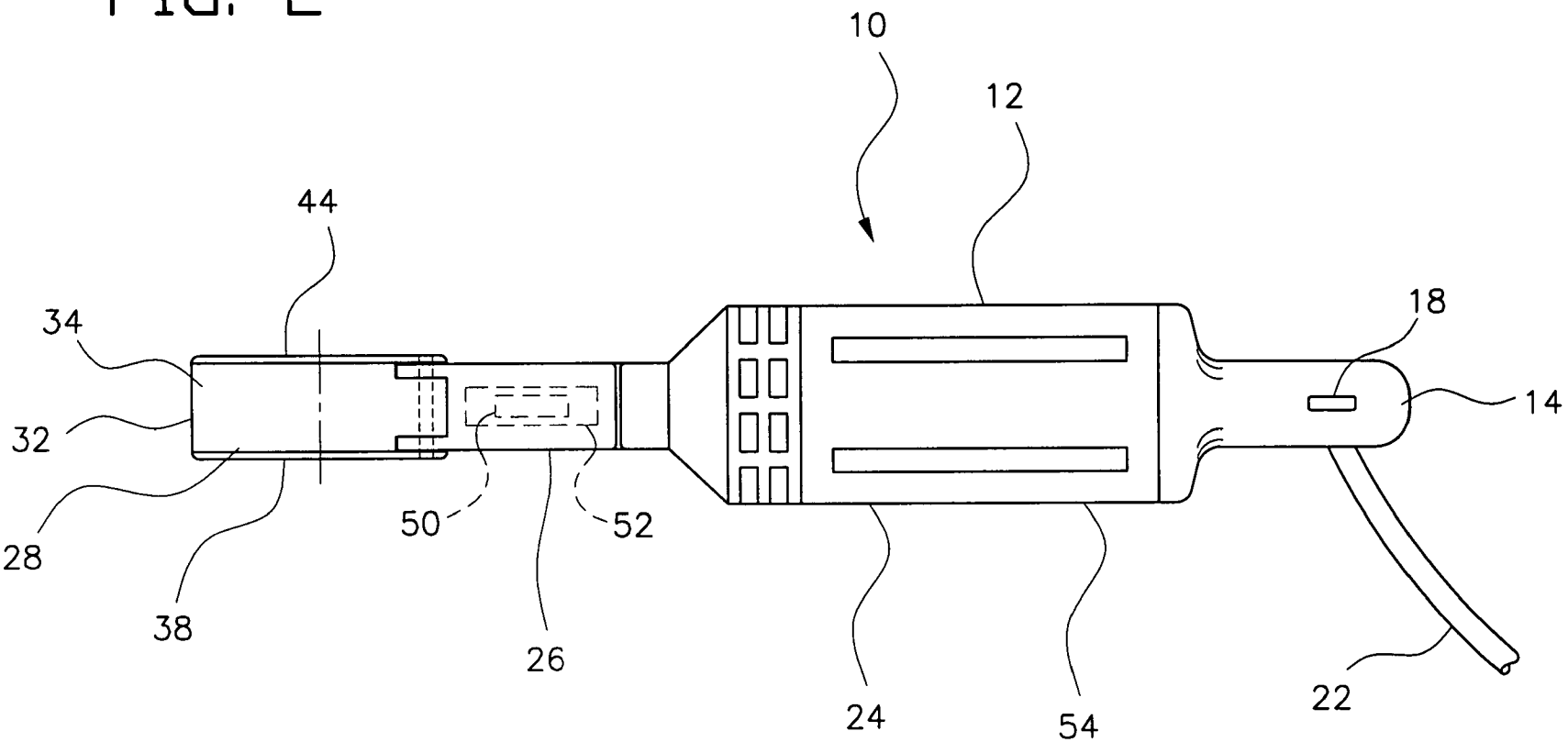
FIG. 2 is a top plan view of the pipe wrench of FIG. 1, showing further details thereof.

FIGS. 1 and 2 show a side view and a top view, respectively, of a powered adjustable pipe wrench 10 according to the present invention. The pipe wrench 10 has a main body 12, an operator's handle 14 incorporating an activating lever 16, an on/off switch 18, a torque-setting knob 20, and a power input 22. An electric cord power input 22 is shown, but it should be understood and be obvious that the invention could use battery, pneumatic or hydraulic power. The powered adjustable pipe wrench 10 in FIGS. 1 and 2 also is shown as having, integral to the main body 12, a motor housing 24, a gearbox housing 26, and a clamping head 28, as well as a locking lever 30.

Figure 3:
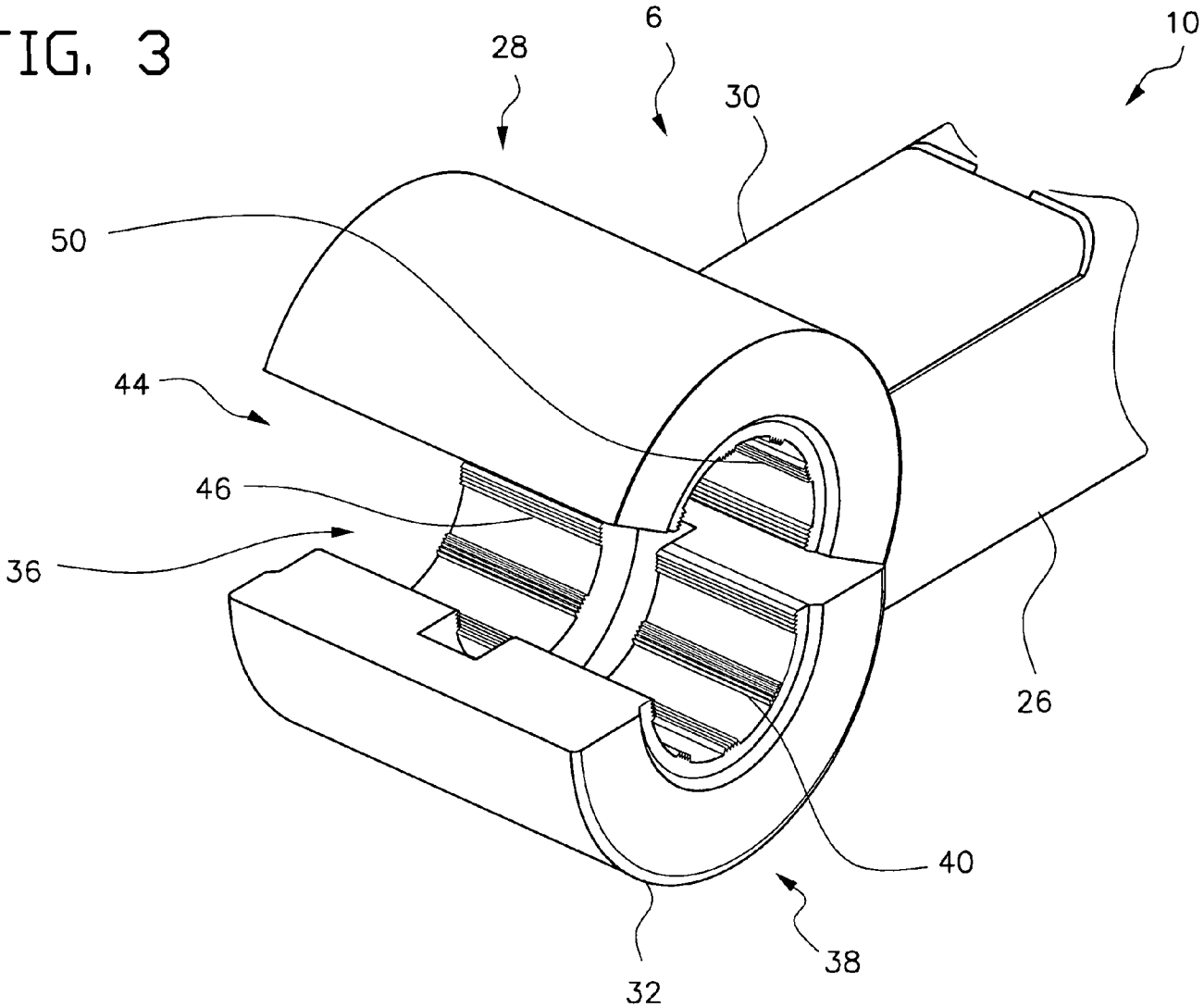
FIG. 3 is a detailed perspective view of the opened jaws of the pipe wrench of FIGS. 1 and 2, showing further details thereof.
Figure 4:
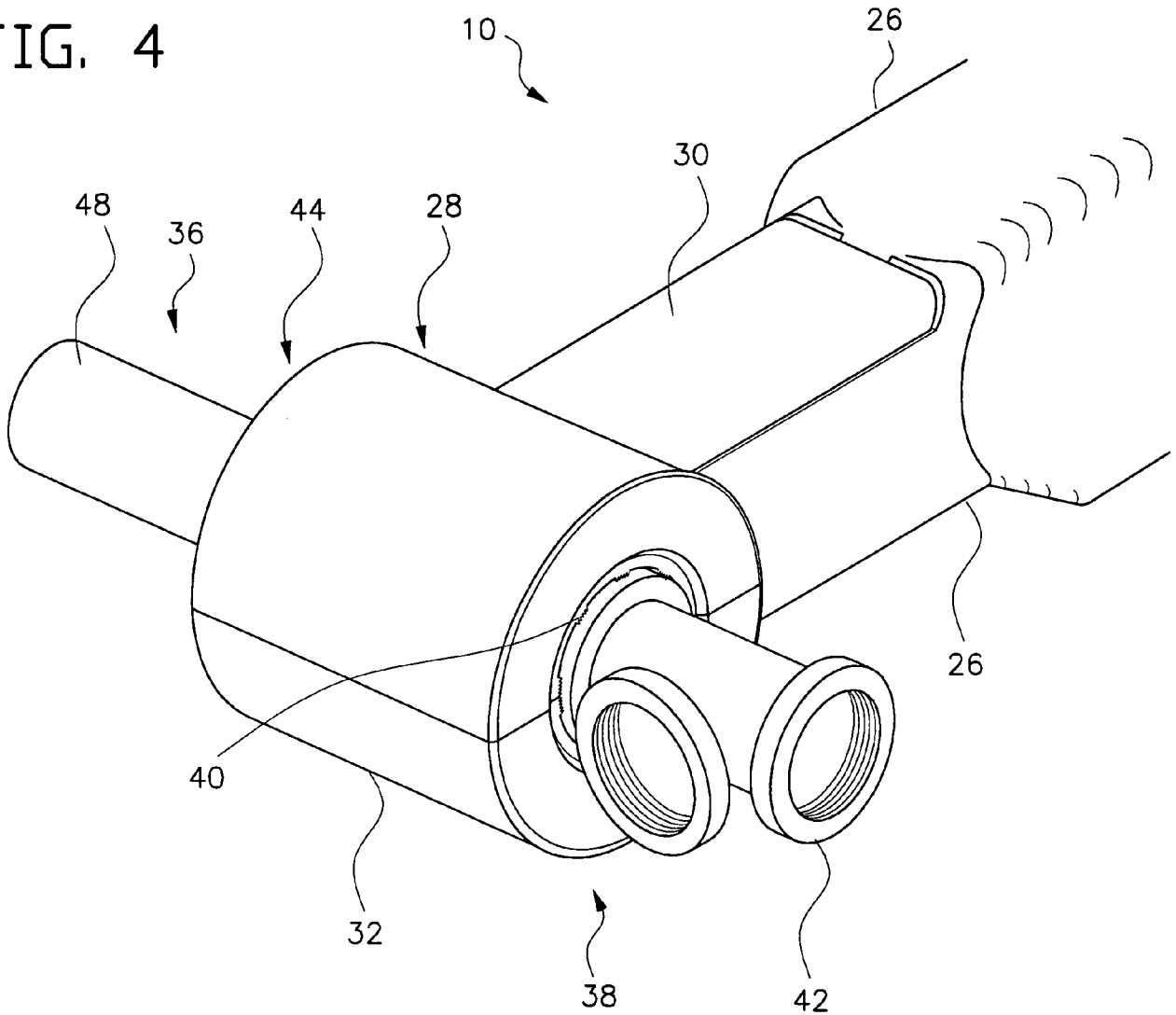
FIG. 4 is an environmental perspective view of the closed jaws of the pipe wrench of FIGS. 1 through 3, showing the device clamped onto a threaded pipe and threaded pipefitting.

The clamping head 28 shown in FIGS. 1 and 2, as well as in the enlarged views of FIGS. 3 and 4, has a stationary head member 32 and a hinged head member 34. When clamped together, the clamping head 28 of pipe wrench 10 defines a cylindrical through-cavity 36, as shown in FIGS. 1, 3, and 4. Internally, on one side 38 of the clamping head 28, non-rotating jaws 40, which are rigidly fixed to both the stationary head member 32 and the hinged head member 34, are spaced along the internal perimeter of the through-cavity 36 and adjusted to provide a stationary non-rotating clamp, e.g., onto a threaded pipe fitting 42, as shown in FIG. 4. Internally, on the opposite side 44 of the clamping head 28, rotating semi-circular jaws 46 (shown in FIG. 3) having gripping teeth thereon are spaced along the internal perimeter of the through cavity 36 and adjusted to clamp onto, e.g., the threaded pipe 48 of FIG. 4.

The rotating jaws 46 are powered for circular rotation for threading of pipe into or out of the threaded pipe fitting 42 by reduction gearing 50 through gearbox 52 powered by drive motor 54. Threading in, threading out, or tightening and loosening of threaded pipe and pipe fittings is accomplished by selecting the direction of rotation with the in/off/out switch 18, shown in FIGS. 1 and 2.

FIG. 4 shows a threaded pipe fitting 42 clamped in the non-rotating side 38 or non-rotating jaws 40 of the device, holding the pipe fitting 42 stationary while rotating or threading the threaded pipe 48 on the opposite side 44 by means of the rotating clamping jaws 46. This operation can be reversed with the threaded pipe 48 being held from rotating and rotating the threaded pipe fitting 42 by turning the powered adjustable pipe wrench 10 over and clamping the threaded pipe 48 on side 38 and clamping the threaded pipe fitting 42 on side 44. This reversing procedure is common practice in plumbing skill.

FIGS. 5 through 9 of the drawings provide illustrations of a second embodiment of the powered adjustable pipe wrench, designated as wrench 100. The powered adjustable pipe wrench 100 includes an elongate housing 102 having a handle portion 104 extending therefrom and a first jaw portion 106 at the end opposite the handle 104. The first jaw portion 106, i.e., the jaw portion integral with the housing 102, includes a powered, rotary grip assembly disposed therein, with the rotary grip assembly having arcuately spaced, coplanar first and second powered rollers 108*a* and 108*b* (shown in FIGS. 7 and 8) therein. The two rollers 108*a* and 108*b* are mounted on respective shafts 109*a* and 109*b*, with both shafts and the second roller 108*b* being shown in FIG. 8, roller 108*a* being mounted on shaft 109*a* and hidden behind the gear train in FIG. 8.

Figure 8:
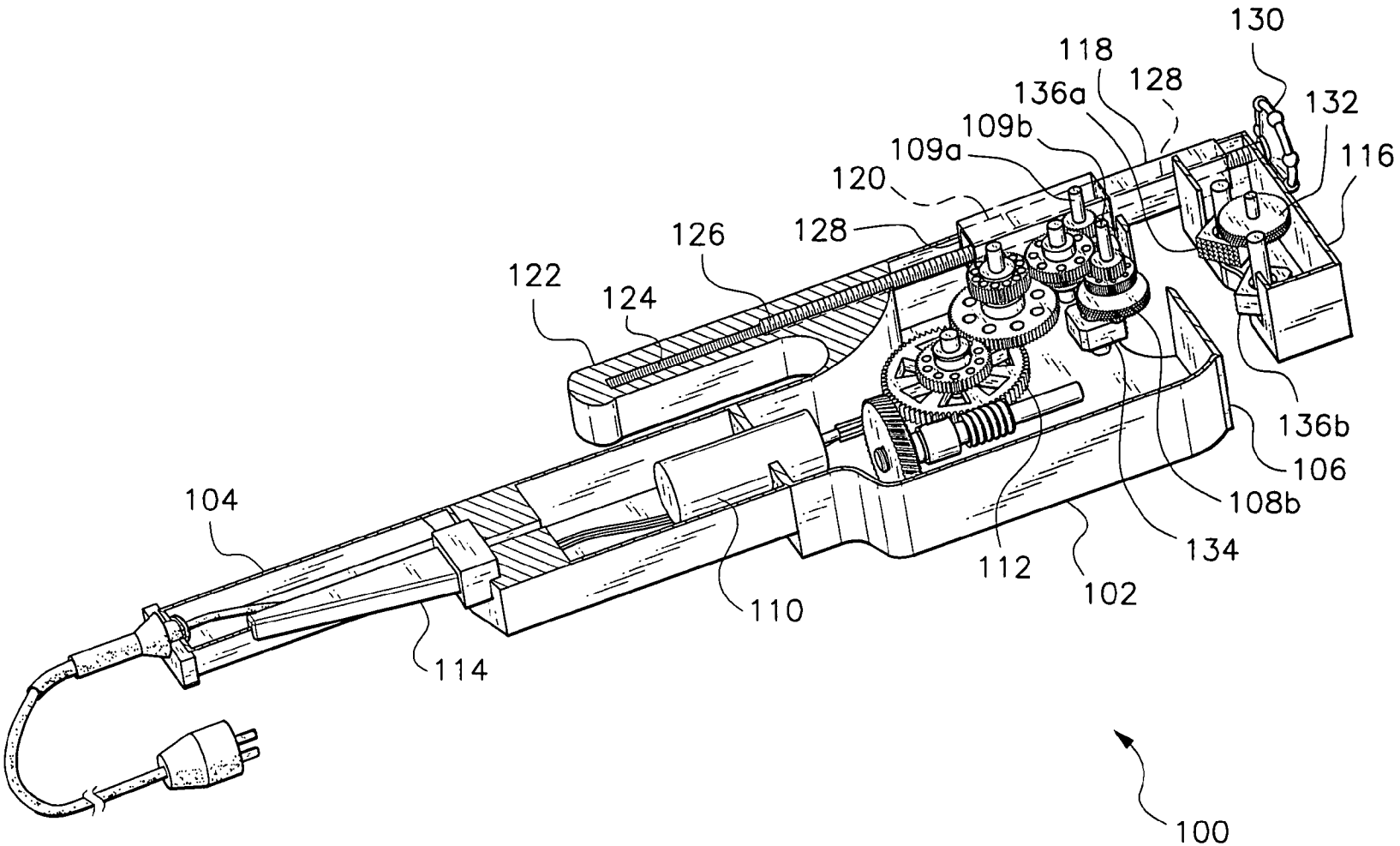
FIG. 8 is a perspective view in axial section of the pipe wrench of FIGS. 5 through 7, showing details of the internal mechanism.
Figure 9:
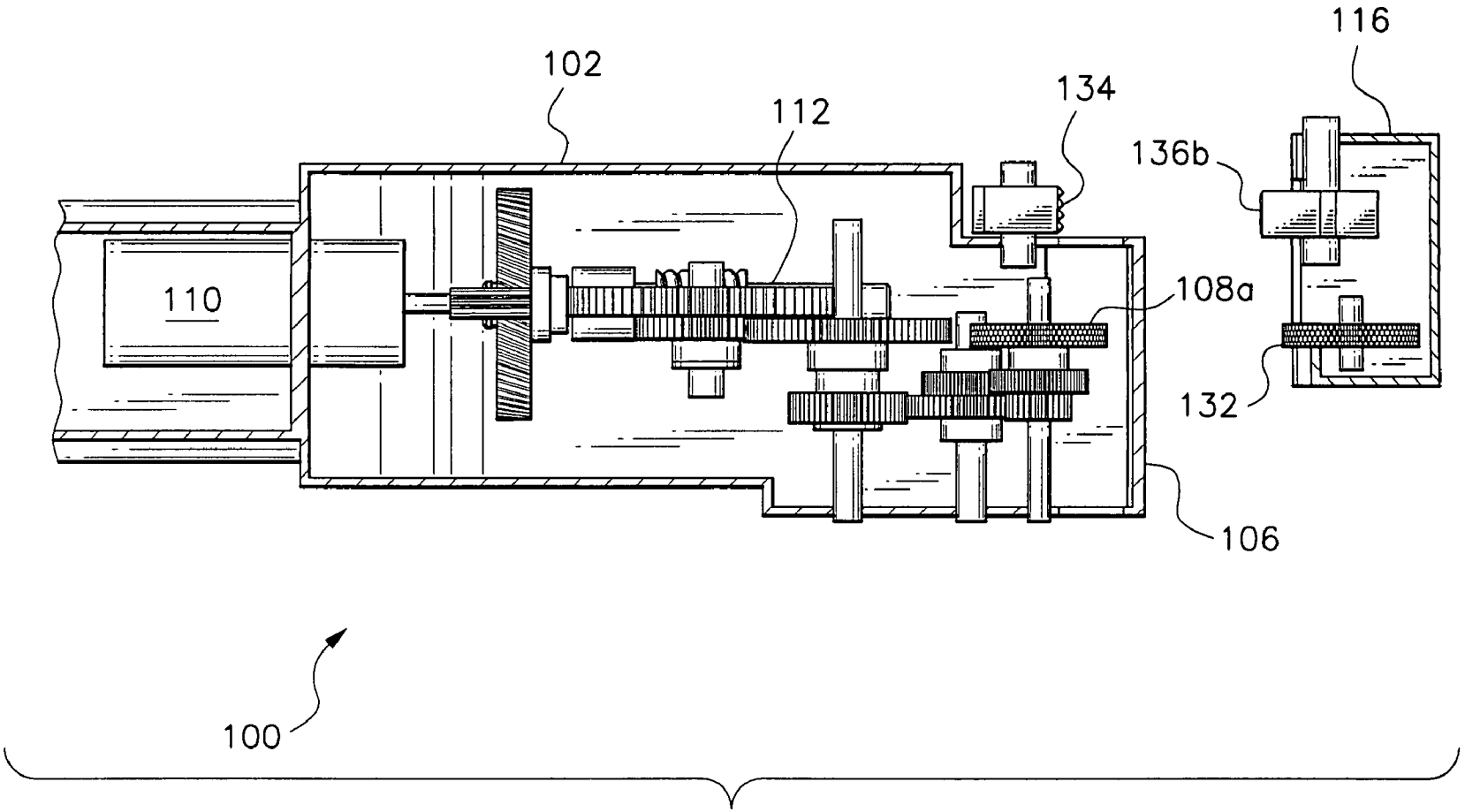
FIG. 9 is a section view drawn along lines 9-9 of FIG. 7.

A motor 110, shown in FIGS. 8 and 9, drives the powered rollers 108*a* and 108*b* through a gear train 112, which mechanically couples the motor 110 to the rollers 108*a*, and 108*b*. The gear train 112 provides significant rotational speed reduction from the motor 110 to the powered rollers 108*a* and 108*b*, and thus significant torque multiplication, allowing a relatively small motor to provide sufficient power for the wrench 100. The motor 110 may comprise an ac or dc electric motor, as desired, with the ac motor receiving electrical power from a conventional electric cord, as shown. The body or housing portion 102 of the device, particularly that portion from which the handle 104 extends, provides sufficient volume to contain a conventional battery pack for powering a dc electric motor. Alternatively, the motor 110 could comprise a pneumatic motor receiving power from a portable air compressor or other suitable pneumatic power source, or a hydraulically powered motor receiving power from a source of hydraulic pressure.

Any of the above motors may be controlled by a suitable switch, as is known in the art of motor operation and speed control. A control switch 114 is illustrated in FIG. 8, with the switch being spring-loaded to a normally off (or electrically open) first position and squeezed or otherwise manipulated to a second position to close the circuit for motor operation and corresponding rotation of the rollers 108*a* and 108*b*. In the case of electric operation, the switch 114 may operate a rheostat or other electric regulation device to control the torque and/or speed of the motor 110. In the cases of pneumatic and hydraulic motors, the switch may respectively control pneumatic or hydraulic pressure or flow, as known in the art.

Figure 7:
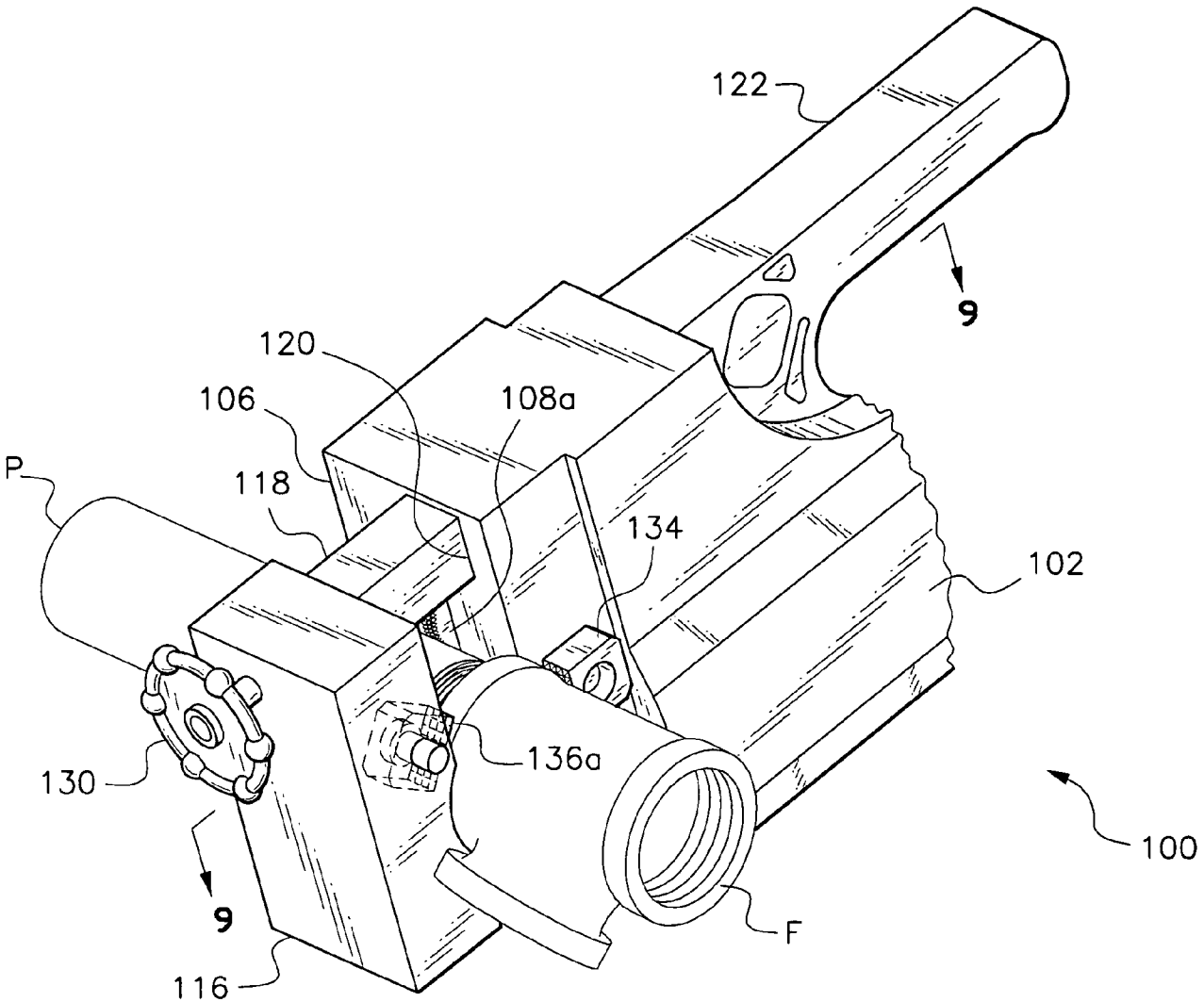
FIG. 7 is a detailed perspective view of the jaw assembly portion of the pipe wrench of FIGS. 5 and 6, showing further details.

A rectilinearly adjustable second jaw portion 116 is disposed diametrically opposite the first jaw portion 106. The second jaw portion 116 has an adjuster shaft 118 extending therefrom, with the second jaw adjuster shaft 118 engaging a second jaw receptacle 120 (shown in FIG. 8) within the housing 102. The second jaw adjuster shaft 118 and second jaw receptacle 120 within the housing 102 are of mutually congruent, non-circular cross section, e.g., square, as shown in FIGS. 7 and 8, in order to prevent axial rotation of the second jaw adjuster shaft 118 relative to its receptacle 120 (alternatively, shaft 118 may be circular with a longitudinally extending key and receptacle 120 may have a corresponding keyway defined therein for the same purpose). The second jaw adjuster shaft 118 slides linearly in and out of its receptacle 120 in the housing 102, thus adjusting the span of the opening between the first jaw portion 106 and the adjustable second jaw portion 116.

The housing 102 includes a secondary handgrip 122 extending rearwardly from the first jaw portion 106, laterally offset from the main portion of the housing 102 and generally aligned with the second jaw receptacle 120 of the housing 102 and the second jaw adjuster shaft 118 adjustably disposed therein. This secondary handgrip 122 portion of the housing includes an internally threaded passage 124 therein, as shown in FIG. 8, concentric with and extending from the second jaw receptacle 120. A threaded adjuster 126 extends through an adjuster passage 128 disposed through the second jaw portion 116 and axially through the adjuster shaft 118, with the adjuster 126 engaging the internally threaded passage 124 of the housing 102, or more precisely the secondary handgrip portion 122 of the housing 102, in order to adjust the span of the opening between the first jaw portion 106 and the adjustable second jaw portion 116. An adjustment knob 130 extends from the distal end of the adjuster 126, i.e., the end extending from the adjustable second jaw portion 116, for a user of the wrench 100 to adjust the span between the first jaw portion 106 and second jaw portion 116.

In order to allow the two powered rollers 108*a* and 108*b* to rotate a length of pipe or pipe fitting clamped within the jaws 106 and 116, another roller 132 is provided within the second jaw portion 116. This non-powered, idler rotary grip element 132 is at least generally coplanar with the two powered rollers 108*a* and 108*b*, as shown particularly in FIG. 9, in order that an object having a round cross section (e.g., a pipe, a pipe fitting, etc.) will be gripped therebetween. The pipe or round object is thus rotated between the two jaws 106 and 116 when the object is gripped firmly between the jaws 108*a*, 108*b*, and 132 and power is applied to the motor 110.

The above-described mechanism serves to rotate the pipe, pipe fitting, etc., between the two jaws 106 and 116 when the wrench 100 is operated. However, an adjacent length of pipe or pipefitting must be held stationary in order to rotate one pipe component relative to the other to assemble or disassemble the two components. This is accomplished by a stationary jaw element 134 disposed within the first jaw portion 106, as shown in FIGS. 7 and 8, and a pair of stationary jaw elements 136*a* and 136*b* disposed within the second jaw portion 116, shown in FIGS. 7 through 9. The stationary jaw element 134 is laterally displaced (or axially displaced relative to an axis normal to the plane of the handle 104 and jaws 106, 116) from the powered rollers 108*a* and 108*b* of the first jaw portion 106, with the stationary jaw elements 136*a*, 136*b* of the second jaw portion 116 also being laterally displaced (or axially displaced relative to an axis normal to the plane of the handle 104 and jaws 106, 116) from the non-powered roller 132. However, the various stationary jaw elements 134, 136*a*, and 136*b* are all coplanar with one another in order to grip a pipe component firmly therebetween when the second jaw component 116 is tightened as described above. The stationary jaw elements 134, 136*a*, and 136*b* may be mounted on pivot pins to allow them to pivot slightly to align with the surfaces of various diameters of pipe clamped therebetween, but they do not rotate, as do the rollers 108*a*, 108*b*, and 132. The fixed elements 134 through 136*b*, and any pipe component clamped therebetween, do not move relative to the jaws 106 and 116 once the wrench 100 has been tightened upon the pipe assembly.

Figure 5:
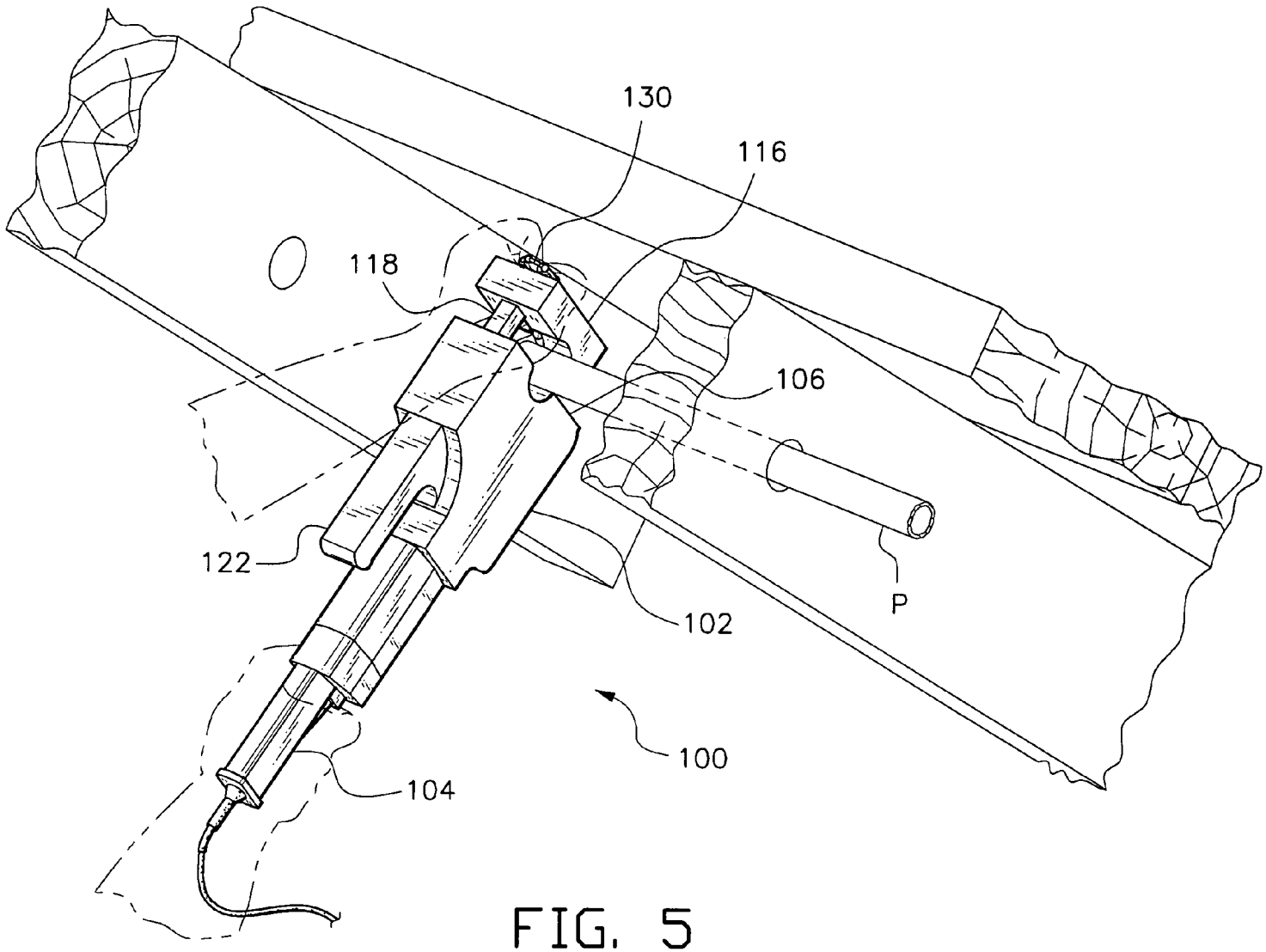
FIG. 5 is an environmental perspective view of a second embodiment of a powered adjustable pipe wrench according to the present invention, showing its placement about a pipe assembly.
Figure 6:
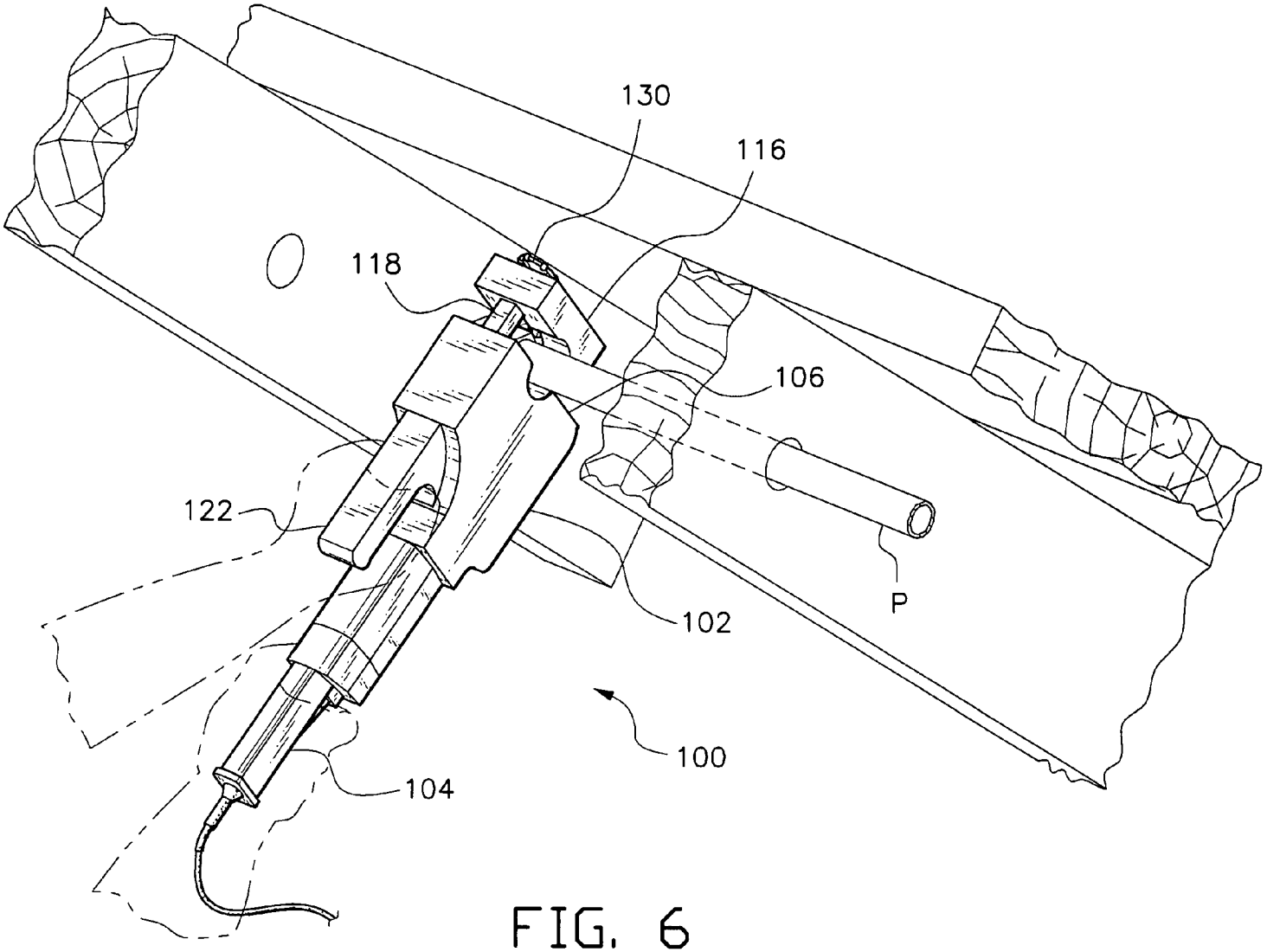
FIG. 6 is an environmental perspective view of the pipe wrench of FIG. 5, showing its operation on a pipe assembly.

FIGS. 5 and 6 illustrate the operation of the powered adjustable pipe wrench 100, with FIG. 7 providing a detailed view of the two jaw portions 106 and 116 gripping a length of pipe P and pipe fitting F. In FIG. 5, the wrench 100 has been placed about a pipe assembly P, with the operator of the wrench shown tightening the adjustment knob 130 to lock the pipe assembly P securely between the two jaws 106 and 116. In FIG. 6, the operator is actuating the switch and switch lever 114 to drive the motor within the housing 102, thereby actuating the gear train 112 therein and causing the two powered rollers 108*a* and 108*b* to rotate, thereby rotating the pipe component gripped between the two powered rollers 108*a*, 108*b* and the non-powered rotary grip element 132 of the second jaw 116.

The portion of the pipe that is to remain relatively stationary is gripped between the various stationary jaw elements 134 through 136*b*, as shown by the stationary pipe fitting F in FIG. 7. Thus, the wrench 100 applies torque through the two powered rollers 108*a* and 108*b* to rotate a pipe component gripped thereby while simultaneously holding the adjoining pipe component stationary relative to the first component. The opposing torques between the rotary and stationary components and jaw elements are canceled due to the powered rollers 108*a* and 108*b* being captured within the structure of the wrench 100. Thus, the operator of the wrench 100 need only hold the actuating switch as required to operate the wrench, without need to apply force to oppose any torque developed by the tool. The motor 110 may be a reversible electric motor to facilitate either threading piping elements together or unthreading piping elements.

Figure 10:
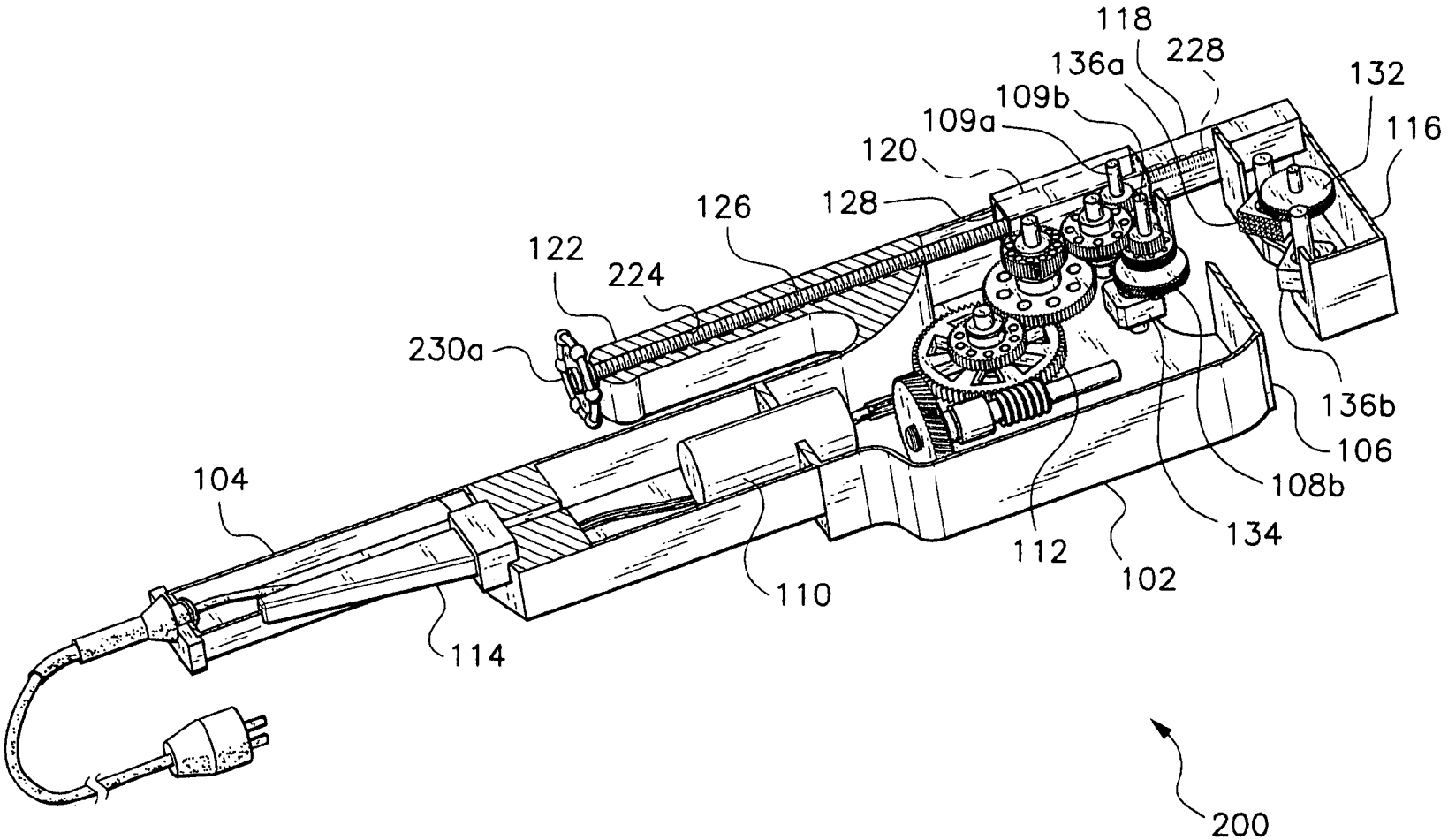
FIG. 10 is a perspective view in axial section similar to FIG. 8, but illustrating an alternative location for the adjuster knob.
Figure 11:
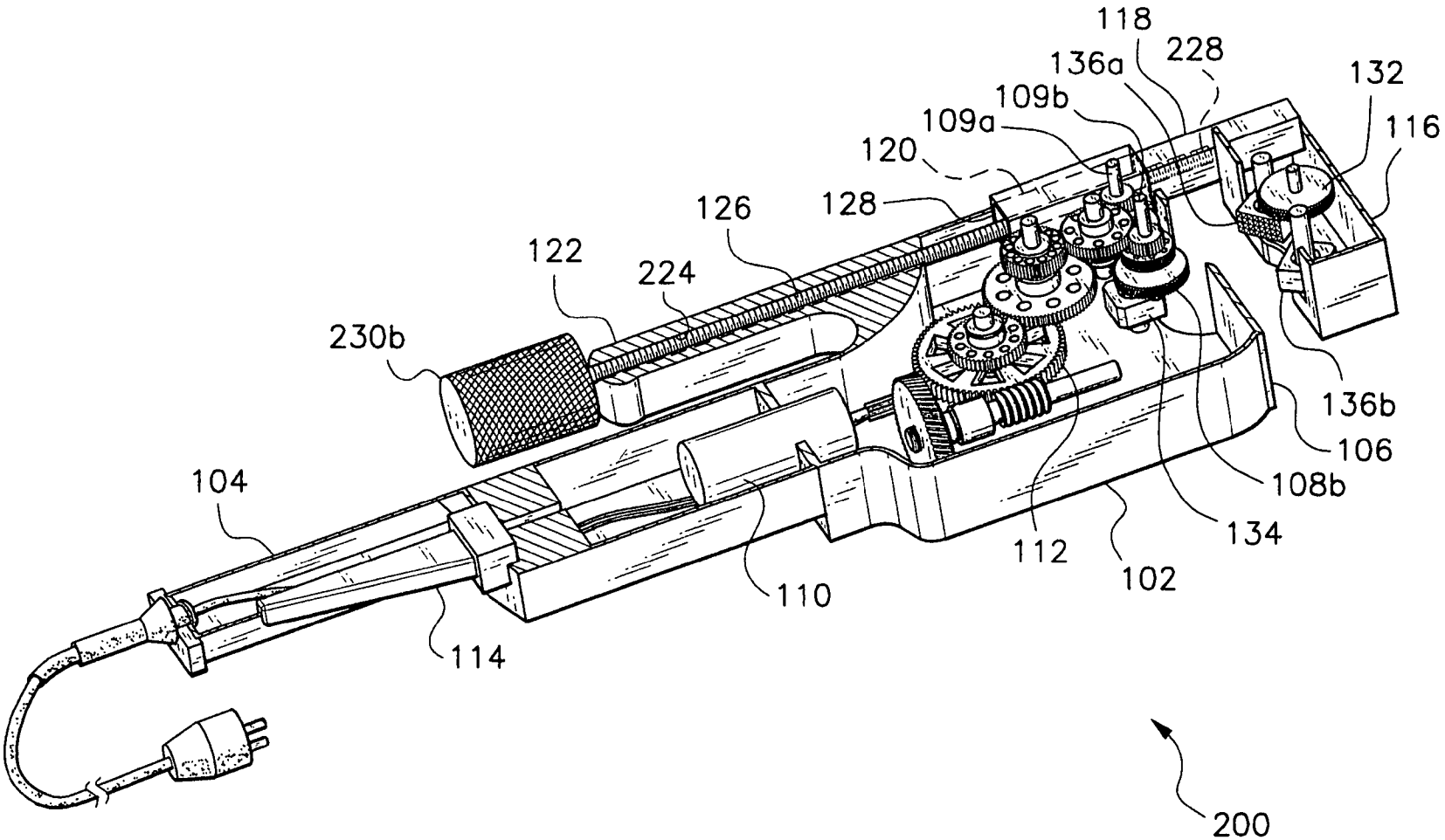
FIG. 11 is a perspective view in axial section similar to FIG. 10, but illustrating an alternative configuration for the adjuster knob.

FIGS. 10 and 11 provide perspective views in axial section of alternative embodiments of the powered adjustable pipe wrench, in which various configurations of the adjuster knob have been relocated relative to the wrench embodiment 100 of FIGS. 5 through 9. Identical reference numerals are used to indicate substantially identical components in the powered wrench embodiments of FIGS. 5 through 11, with only the overall wrenches and differently configured components thereof being assigned different reference numerals. The powered wrench 200 of FIG. 11 has substantially the same configuration as the wrench 200 of FIG. 10, with the exception of the differently configured adjuster knob 230*b*.

The powered wrench 200 of FIGS. 10 and 11 is substantially the same as the powered wrench 100 of FIGS. 5 through 9, with the exception of the relocation of the jaw adjustment knob 230*a* or 230*b* and necessary changes to the associated mechanism. Rather than placing the adjuster knob at the distal end of the adjustable second jaw portion 116 of the device and requiring the user to reach to the opposite end of the wrench from the handle 104, the adjuster knob 230*a* (or 230*b*) of the wrench 200 has been placed at the distal end of the secondary handgrip 122, i.e., the end closest to the major handle portion 104 of the device. This results in an interchange of the threaded and unthreaded portions of the adjuster passages through the secondary handle 122 and the jaw adjuster shaft 118.

In the wrench 200 of FIGS. 10 and 11, the internal passage 224 is unthreaded to allow the threaded adjuster 126 to rotate therein without axial advancement or retraction within the passage 224. However, the adjuster passage 228 through the second jaw adjuster shaft 118 is internally threaded. Thus, rotation of the adjuster knob 230*a* or 230*b* results in the threaded shaft 126 either drawing the second jaw adjuster shaft 118 and its attached second jaw 116 closer to the fixed first jaw 106, or extending the second jaw adjuster shaft 118 and second jaw 116 farther from the first jaw 106. This relocation of the adjuster knob 230*a* or 230*b* facilitates manipulation of the tool 200 by the user, as there is no longer a need to reach to the opposite end of the tool.

It is to be understood that the present invention is not limited to the embodiments described above, but encompasses any and all embodiments within the scope of the following claims.

I claim:

1. A powered adjustable pipe wrench, comprising:

an elongated housing having a handle end and an opposing jaw end;

a fixed jaw and a movable jaw disposed at the jaw end of the handle;

first and second sets of gripping elements disposed in the fixed and movable jaws, the first and second sets being laterally spaced apart, the first set of gripping elements having opposing gripping surfaces adapted for holding a first piping element stationary when the fixed and movable jaws are approximated towards each other, the second set of gripping elements having opposing gripping surfaces including at least one rotatable gripping surface, the second set being adapted for gripping and rotating a second piping element when the fixed and movable jaws are approximated towards each other in order to thread the first and second piping elements together or to unthread the first and second piping elements;

a motor disposed in the housing;

a gear train coupling the motor to the at least one rotatable gripping surface of the second set of gripping elements; and a switch electrically connected to the motor, the switch being movable between a first position in which the at least one rotatable gripping surface of the second set of gripping elements remains stationary and a second position in which the motor drives the at least one rotatable gripping surface to rotate.

2. The powered adjustable pipe wrench according to claim 1, further comprising a hinge connecting the fixed jaw and the movable jaw.

3. The powered adjustable pipe wrench according to claim 1, further comprising a threaded rod connecting the fixed jaw and the movable jaw.

4. The powered adjustable pipe wrench according to claim 1, wherein the gripping surfaces in said second set of gripping elements comprise first and second adjacent rollers extending from said fixed jaw and an idler roller extending from said movable jaw, the first and second rollers being driven by said motor and said gear train.

5. The powered adjustable pipe wrench according to claim 4, wherein said first and second rollers and said idler roller are substantially coplanar.

6. The powered adjustable pipe wrench according to claim 1, further comprising a secondary handgrip laterally offset from said handle extending from said housing.

7. The powered adjustable pipe wrench according to claim 1, wherein said motor comprises a reversible electric motor.

8. A powered adjustable pipe wrench, comprising:

an elongate housing having a handle portion and a first jaw portion opposite the handle portion, the housing having a second jaw receptacle formed therein, the second jaw receptacle having a non-circular cross section;

a powered rotary grip assembly disposed within the first jaw portion;

a motor disposed within the housing;

a gear train coupling the motor to the rotary grip assembly;

a switch electrically connected to the motor, the switch being movable between a first position in which the rotary grip assembly remains stationary and a second position in which the motor drives the rotary grip assembly to rotate;

a second jaw portion adjustably disposed opposite the first jaw portion;

an adjuster shaft extending from the second jaw portion and adjustably engaging the second jaw receptacle, the adjuster shaft having a non-circular cross section congruent with the cross section of the second jaw receptacle; and an idler rotary grip element disposed within the second jaw portion opposite the powered rotary grip assembly of the first jaw portion.

9. The powered adjustable pipe wrench according to claim 8, wherein the housing has an internally threaded passage extending from the second jaw receptacle, and said second jaw portion and said adjuster shaft have an adjuster passage formed therethrough, the powered adjustable pipe wrench further comprising a threaded adjuster disposed within the adjuster passage of said second jaw portion and said adjuster shaft, the threaded adjuster engaging the internally threaded passage of the housing.

10. The powered adjustable pipe wrench according to claim 8, further including:

at least one stationary jaw element disposed within the first jaw portion, the first jaw portion stationary jaw element being laterally separated from the rotary grip assembly; and at least one stationary jaw element disposed within the second jaw portion, the second jaw portion stationary jaw element being laterally separated from the non-powered rotary grip element and being disposed opposite the stationary jaw element of the first jaw portion.

11. The powered adjustable pipe wrench according to claim 8, further including a secondary handgrip laterally offset from the housing and generally aligned with the second jaw receptacle and adjuster shaft of the second jaw portion.

12. The powered adjustable pipe wrench according to claim 8, wherein the motor is an electric motor.

13. The powered adjustable pipe wrench according to claim 8, wherein the motor is a pneumatically powered motor.

14. The powered adjustable pipe wrench according to claim 8, wherein the motor is a hydraulically powered motor.

15. A powered adjustable pipe wrench, comprising:

an elongate housing having a handle portion and a first jaw portion opposite the handle portion;

a powered, rotary grip assembly disposed within the first jaw portion;

a motor disposed within the housing;

a gear train coupling the motor to the rotary grip assembly of the first jaw portion;

a switch electrically connected to the motor, the switch being movable between a first position in which the rotary grip assembly remains stationary and a second position in which the motor drives the rotary grip assembly to rotate;

at least one stationary jaw element disposed within the first jaw portion, the first jaw portion stationary jaw element being laterally separated from the rotary grip assembly;

a rectilinearly adjustable second jaw portion disposed opposite the first jaw portion, the housing having a second jaw receptacle formed therein, the second jaw receptacle having a non-circular cross section;

an adjuster shaft extending from the second jaw and adjustably engaging the second jaw receptacle, the adjuster shaft having a non-circular cross section corresponding to the cross section of the second jaw receptacle;

an idler rotary grip element disposed within the second jaw portion opposite the powered rotary grip assembly of the first jaw portion; and at least one stationary jaw element disposed within the second jaw portion opposite the first jaw portion stationary jaw element, the second jaw portion stationary jaw element being laterally separated from the idler rotary grip element.

16. The powered adjustable pipe wrench according to claim 15, wherein the housing has an internally threaded passage extending from the second jaw receptacle, and said second jaw portion and said adjuster shaft have an adjuster passage formed therethrough, the powered adjustable pipe wrench further comprising a threaded adjuster disposed within the adjuster passage of said second jaw portion and said adjuster shaft, the threaded adjuster engaging the internally threaded passage of the housing.

17. The powered adjustable pipe wrench according to claim 15, wherein the housing defines an internal passage extending from the second jaw receptacle and said adjuster shaft has a threaded adjuster passage formed therethrough, the powered adjustable pipe wrench further comprising a threaded adjuster disposed within the threaded adjuster passage of said adjuster shaft, the threaded adjuster engaging the internally threaded passage of the adjuster shaft.

18. The powered adjustable pipe wrench according to claim 15, further including a secondary handgrip laterally offset from the housing and generally aligned with the second jaw receptacle and adjuster shaft of the second jaw portion.

19. The powered adjustable pipe wrench according to claim 15, wherein the motor is selected from the group consisting of an electric motor, a pneumatically powered motor, and a hydraulically powered motor.

* * * * *